US006305278B1

(12) United States Patent
Freeberg

(10) Patent No.: US 6,305,278 B1
(45) Date of Patent: Oct. 23, 2001

(54) PORTABLE REFUSE COMPACTOR

(76) Inventor: John Freeberg, 2874 Progress Pl., Escondido, CA (US) 92029

( * ) Notice: Subject to any disclaimer, the term of this patent is extended or adjusted under 35 U.S.C. 154(b) by 0 days.

(21) Appl. No.: 09/615,610

(22) Filed: Jul. 14, 2000

(51) Int. Cl.[7] ..... B30B 15/00
(52) U.S. Cl. ..... 100/100; 100/229 R
(58) Field of Search ..... 100/100, 214, 100/229 R, 231, 233, 236, 269.17, 270, 283, 284

(56) References Cited

U.S. PATENT DOCUMENTS 1,852,507 * 4/1932 Davis ..... 100/233
3,280,727 * 10/1966 Jonas ..... 100/100
3,357,346 * 12/1967 Crafoord ..... 100/233
3,797,382 * 3/1974 Muzzi et al. ..... 100/100
4,700,623 * 10/1987 Durbin et al. ..... 100/100
5,619,915 * 4/1997 Wagner et al. ..... 100/100

* cited by examiner

*Primary Examiner*—Peter Vo
*Assistant Examiner*—Louis K. Huynh
(74) *Attorney, Agent, or Firm*—Craig M. Korfanta

(57) ABSTRACT

A portable refuse compactor 10 has a mobile compression frame 11 including a base 12 in the general shape of a "T". A trash bin bottom engagement surface 13 on the trunk of the "T" provides a purchase point against which compacting takes place. Compacting platen 15 is positioned above, and moveable with respect to, bin bottom engagement surface 13. Hydraulic ram 19 displaces platen 15 toward the bin bottom engagement surface 13.

3 Claims, 3 Drawing Sheets

PORTABLE REFUSE COMPACTOR

BACKGROUND OF THE INVENTION

1. Technical Field

This invention generally relates to the trash compactors. More specifically, this invention relates to a portable trash compactor for reducing the volume occupied by trash in dumpsters or similar trash bins.

2. Background

Many businesses and organizations are faced with disposing of large amounts of trash or refuse. In most cases, they are charged for disposal by both by the volume and frequency of disposal. A single organization may possess several dumpsters to reduce the frequency of pick-ups or to fit within a designated schedule of the solid waste disposal company. Other organizations install large permanent compactors that have removable bins for emptying, usually on an as needed basis. Compacting the waste within the bin greatly reduces the frequency for emptying the dumpsters as a large amount of internal space is otherwise unoccupied. Additionally, the nature of a large percentage of refuse tends to be mostly empty space. Unfortunately, large compactors are expensive to purchase and install, often requiring modifications to the facility.

What is needed is an inexpensive portable compactor that can be used with most standard dumpsters to reduce the volume of refuse and enable less frequent emptying.

SUMMARY OF THE INVENTION

One embodiment of the invention provides a portable refuse compactor having a mobile compression frame, including a trash bin bottom engagement surface; a compacting platen positioned above, and moveable with respect to, the bin bottom engagement surface; and a force generator for displacing the platen toward the bin bottom engagement surface. Here, the compression frame includes a base having three caster wheels attached thereto to facilitate mobility and an upwardly facing surface defining the bin bottom engagement surface. An upright is attached to the base opposite the engagement surface and extends upwardly from the base. A compacting lever is pivotally attached near the upper end of the upright between proximal and distal ends of the compacting lever. A compacting platen is pivotally attached to the compacting lever at its distal end. A hydraulic ram is connected between the frame and the proximal end of the compacting lever such that expansion of the ram under hydraulic pressure pivots the distal end of the compacting lever through a downward arc. The compacting platen here has an upright extending therefrom to which the distal end of the compacting lever is pivotally attached and a vertical guide lever is pivotally attached. The other end of the vertical guide lever is pivotally attached to the compression frame in parallel spaced relation to the compression lever. The vertical guide lever maintains the compacting platen upright in a vertical orientation throughout the arc of travel of the distal end of the compacting lever. The hydraulic ram may be supplied by an electrical, gasoline or manually powered hydraulic pump.

Another embodiment of the invention has the compacting platen attached to the compacting arm using a gimbaled connection to ensure that the platen maintains even pressure across its surface area.

Additional advantages and novel features of the invention will be set forth in part in the description that follows, and in part will become apparent to those skilled in the art upon examination of the following or may be learned by practice of the invention.

DETAILED DESCRIPTION OF THE INVENTION

Figure 1:
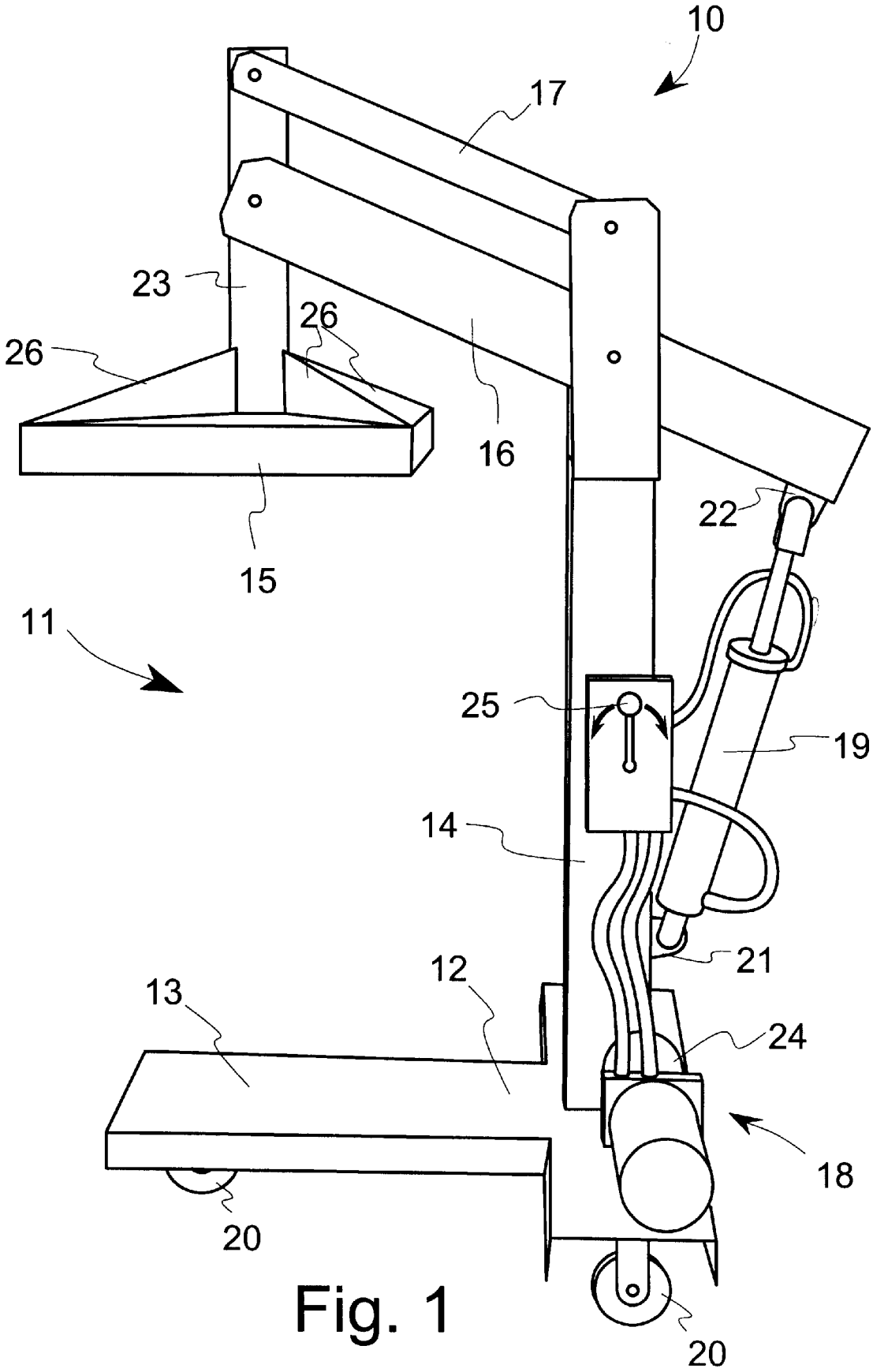
FIG. 1 is a perspective view of a portable trash compactor according to one embodiment of the invention.
Figure 2:
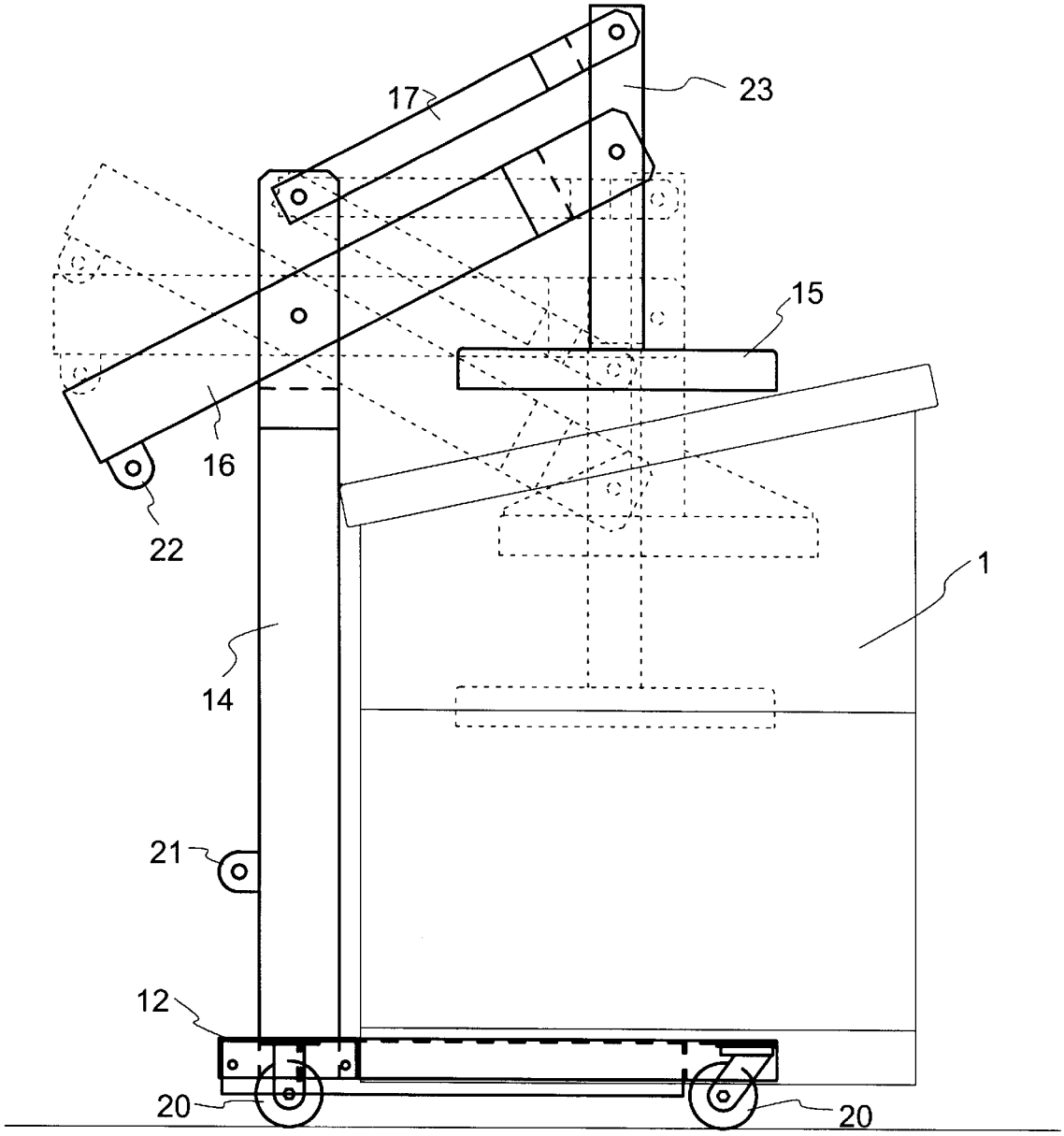
FIG. 2 is a side view of the embodiment of FIG. 1 with the hydraulics removed for illustration purposes.
Figure 3:
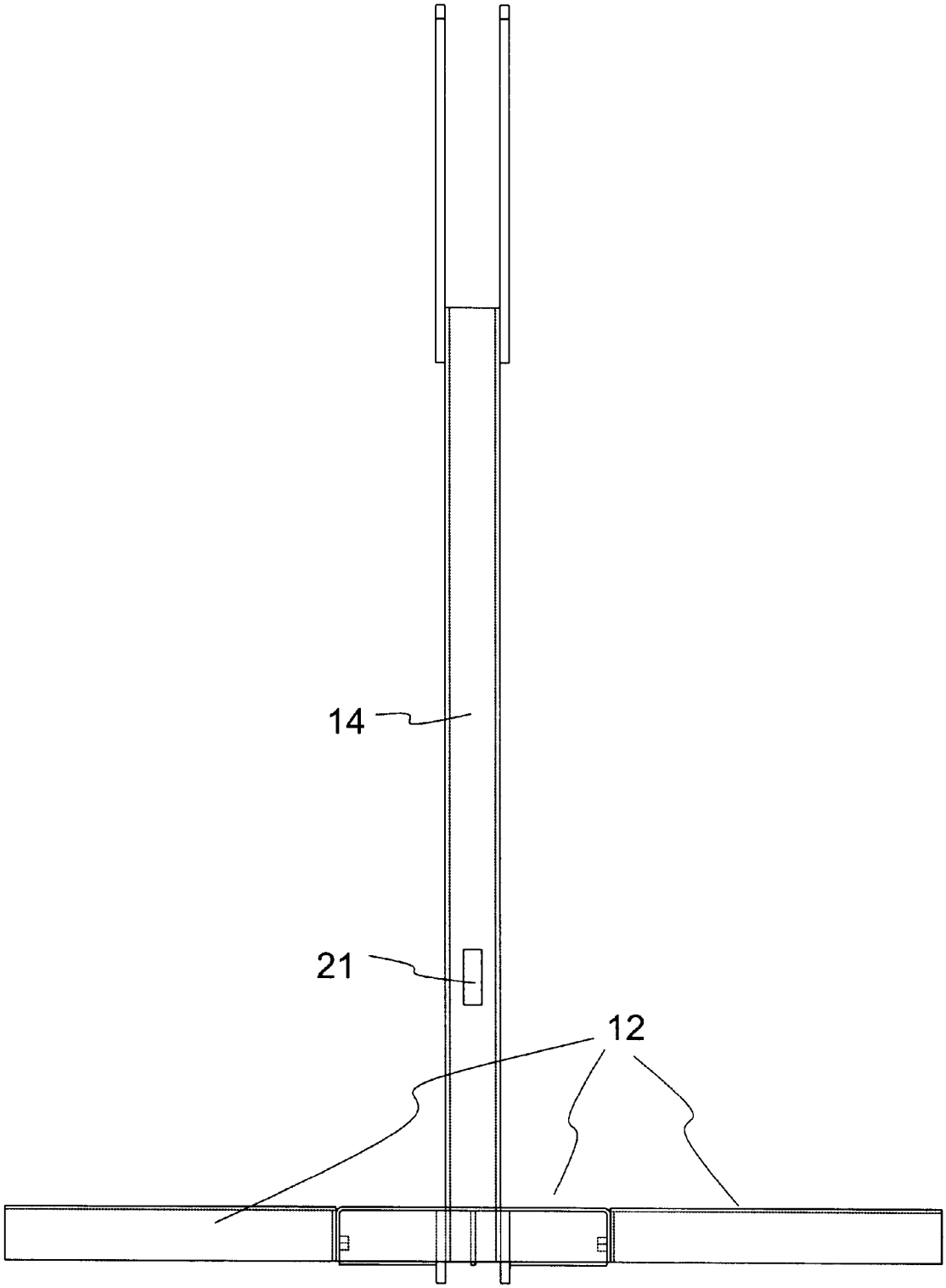
FIG. 3 is a is a back side view of the base and upright of the embodiment of FIG. 1.

Referring now to the figures, a portable refuse compactor 10 is illustrated according to one embodiment of the invention. Here compactor 10 has a mobile compression frame 11 including a base 12 in the general shape of a "T". A trash bin bottom engagement surface 13 on the trunk of the "T" provides a purchase point against which compacting takes place. Compacting platen 15 is positioned above, and moveable with respect to, bin bottom engagement surface 13. Hydraulic ram 19 displaces platen 15 toward bin bottom engagement surface 13 thereby compressing the refuse between platen 15 and the bottom of dumpster 1, which is support by bin bottom engagement surface 13.

Here, compression frame 11 has three caster wheels 20 attached to the underside of base 12 to facilitate mobility of the entire unit. Upright 14 is attached to base 12 opposite engagement surface 13 at the top of the trunk of the "T". Compacting lever 16 is pivotally attached near the upper end of upright 14 between proximal and distal ends of compacting lever 16. Compacting platen 15 is pivotally attached to compacting lever 16 at the distal end of compacting lever 16. Hydraulic ram 19 is connected between frame lug 21 and lever lug 22 on the proximal end of compacting lever 16 such that expansion of ram 19 under hydraulic pressure pivots the distal end of compacting lever 16 through a downward or upward arc, consequently lowering or raising platen 15. Here and advantageously, hydraulic ram 19 is a double acting or bi-directional cylinder meaning that it will expand or contract depending upon which side of the cylinder hydraulic pressure is applied. Actuator valve 25 selects which side of the cylinder hydraulic pressure is applied to. An additional optional advantage is to include a check valve within the actuator which stops cylinder movement at any point in either direction and "freeze" platen 15 in its current position.

Compacting platen 15 here includes platen upright 23 extending therefrom to which the distal end of compacting lever 16 is pivotally attached. A vertical guide lever 17 is also pivotally attached at its distal end to platen upright 23 above compacting lever 16. The other end of vertical guide lever 17 is pivotally attached to the upper end of upright 14 in parallel spaced relation to compression lever 16. Vertical guide lever 17 acts to maintain platen upright 23 in a vertical orientation throughout the arc of travel of the distal end of compacting lever 16. Here, platen 15 is supported by four webs 26 extending radially outward from platen upright 23 on the upper side of platen 15. Another embodiment has webs 26 positioned on the under compacting side of platen 15. This configuration places webs 26 under tension during compaction as opposed to compression when webs 26 are on the upper side of platen 15.

Hydraulic ram 19 is here supplied by an electrically powered hydraulic pump 24. However, it should be noted that ram 19 may be supplied by other sources such as gasoline or manually powered hydraulic pumps. Additionally, ram 19 could be replaced all together by mechanical devices such as a jack screw or similar displacement device.

A big advantage of the compression frame configuration is that the compaction load is born almost entirely by the refuse within dumpster 1 as opposed to the legs or casters supporting dumpster 1, the exception being the weight of portable compactor 10 which is small in comparison to the compressive force. Additionally, the load to which casters 20 are subjected is actually reduced during compaction to less than the weight of compactor 10. Consequently, fatigue on both dumpster 1 and compactor 10 is minimized.

Another embodiment of the invention has compacting platen 15 attached to compacting lever 16 using a gimbaled connection (not shown) to ensure that platen 15 maintains even pressure across its surface area.

While there are shown and described certain embodiments of the invention, it is to be distinctly understood that this invention is not limited thereto but may be variously embodied to practice within the scope of the following claims.

I claim:

1. A portable refuse compactor for compacting refuse within a trash bin which comprises:

a mobile compression frame including a base having a trash bin bottom engagement surface, the frame including at least one wheel attached to the frame, the trash bin bottom engagement surface removably insertable under the trash bin;

an upright attached at and extending upward from the base;

a compacting lever pivotally attached along the upright between proximal and distal ends of the compacting lever;

a compacting platen connected to the distal end of the compacting lever such that the compacting platen is positioned above, and moveable with respect to, the trash bin bottom engagement surface; and a force generator pivotally attached to the upright and the proximal end of the compacting lever for displacing the compacting lever and the platen through a downward arc toward the bin bottom engagement surface.

2. The compactor of claim 1 wherein the force generator comprises a hydraulic ram pivotally connected between the upright and the proximal end of the compacting lever.

3. The compactor of claim 2 further comprising:

the compacting platen having an upright extending therefrom to which the distal end of the compacting lever is pivotally attached; and a vertical guide lever pivotally attached at a proximal end to the upright and pivotally attached to the platen upright in parallel spaced relation to the compacting lever.

* * * * *